US010199143B2

(12) United States Patent
Ko et al.

(10) Patent No.: US 10,199,143 B2
(45) Date of Patent: Feb. 5, 2019

(54) POWER CABLE

(71) Applicant: LS CABLE & SYSTEM LTD., Anyang-si, Gyeonggi-do (KR)

(72) Inventors: Kyoung-Ro Ko, Daegu (KR); Ju-Yeon Lee, Chuncheon-si (KR)

(73) Assignee: LS CABLE & SYSTEM LTD., Anyang-si, Gyeonggi-Do (KR)

( * ) Notice: Subject to any disclaimer, the term of this patent is extended or adjusted under 35 U.S.C. 154(b) by 0 days.

(21) Appl. No.: 15/549,828

(22) PCT Filed: Feb. 16, 2016

(86) PCT No.: PCT/KR2016/001535
§ 371 (c)(1),
(2) Date: Aug. 9, 2017

(87) PCT Pub. No.: WO2016/133332
PCT Pub. Date: Aug. 25, 2016

(65) Prior Publication Data

US 2018/0025810 A1 Jan. 25, 2018

(30) Foreign Application Priority Data

Feb. 17, 2015 (KR) ..... 10-2015-0024385
Nov. 27, 2015 (KR) ..... 10-2015-0167050

(51) Int. Cl.
*H01B 7/00* (2006.01)
*H01B 9/02* (2006.01)
(Continued)

(52) U.S. Cl.
CPC ..... *H01B 9/02* (2013.01); *H01B 3/48* (2013.01); *H01B 7/02* (2013.01); *H01B 7/20* (2013.01);
(Continued)

(58) Field of Classification Search
USPC .... 174/102 R, 103, 104 R, 105, 106 R, 108, 174/109
See application file for complete search history.

(56) References Cited

U.S. PATENT DOCUMENTS 3,773,965 A * 11/1973 Reynolds ..... H01B 7/0233 174/25 G
6,207,261 B1 * 3/2001 Kuwabara ..... H01B 3/54 174/110 PM
(Continued)

FOREIGN PATENT DOCUMENTS

CN 102712179 A 10/2012
CN 103959400 A 7/2014
(Continued)

OTHER PUBLICATIONS

International Search Report for PCT/KR2016/001535 dated Jun. 2, 2016 from Korean Intellectual Property Office.
(Continued)

*Primary Examiner* — William H Mayo, III
(74) *Attorney, Agent, or Firm* — K&L Gates LLP

(57) ABSTRACT

A power cable includes an insulation layer, itself, having high dielectric strength. An electric field to be applied to the insulation layer is effectively buffered, degradation of the insulation layer can be prevented during a cable connection step such that the life of the power cable is extended and simultaneously, the thickness of the insulation layer is minimized such that an outer diameter of the cable is reduced, thereby enabling flexibility, ease of installation, workability and the like of the cable to be improved.

11 Claims, 4 Drawing Sheets

(51) Int. Cl.

| | |
|---|---|
| ***H01B 7/02*** | (2006.01) |
| ***H01B 7/20*** | (2006.01) |
| ***H01B 9/06*** | (2006.01) |
| ***H01B 3/48*** | (2006.01) |

(52) U.S. Cl.
CPC ..... *H01B 9/0688* (2013.01); *H01B 9/0694* (2013.01)

(56) References Cited

U.S. PATENT DOCUMENTS

| | | | | |
|---|---|---|---|---|
| 9,959,955 | B2 * | 5/2018 | Na | H01B 12/06 |
| 2001/0042635 | A1 * | 11/2001 | Kondo | H01B 3/22 174/110 R |
| 2004/0256126 | A1 * | 12/2004 | Ashibe | H01R 4/68 174/15.5 |
| 2009/0082210 | A1 * | 3/2009 | Ashibe | H01B 12/14 505/230 |
| 2009/0229848 | A1 * | 9/2009 | Hirose | H01B 12/14 174/15.5 |
| 2012/0285725 | A1 * | 11/2012 | Maritano | H01B 3/52 174/120 FP |
| 2013/0196857 | A1 * | 8/2013 | Mukoyama | C01G 3/00 505/230 |
| 2014/0251654 | A1 * | 9/2014 | Liu | H01B 7/02 174/25 R |

FOREIGN PATENT DOCUMENTS

| | | | | | |
|---|---|---|---|---|---|
| EP | 0843320 | A | | 5/1998 | |
| JP | 10-199338 | | * | 7/1998 | H01B 3/54 |
| JP | 10-199338 | A | | 7/1998 | |
| JP | 2010-097778 | A | | 4/2010 | |
| JP | 2011-216292 | A | | 10/2011 | |
| JP | 2013-098136 | A | | 5/2013 | |
| JP | WO2013/075756 | A1 | * | 5/2013 | H01B 9/06 |
| KR | 10-2004-0038180 | A | | 5/2004 | |
| KR | 10-2009-0043198 | A | | 5/2009 | |
| KR | 10-1102100 | B1 | | 1/2012 | |

OTHER PUBLICATIONS

Chinese Office Action for related Chinese Application No. 201680009512.1; action dated Aug. 9, 2018; (10 pages).
Extended European Search Report for related European Application No. 16752662.3; report dated Sep. 12, 2018;(9 pages).

* cited by examiner

POWER CABLE

CROSS REFERENCE TO PRIOR APPLICATIONS

This application is a National Stage Patent Application of PCT International Patent Application No. PCT/KR2016/001535 (filed on Feb. 16, 2016) under 35 U.S.C. § 371, which claims priority to Korean Patent Application Nos. 10-2015-0024385 (filed on Feb. 17, 2015) and 10-2015-0167050 (filed on Nov. 27, 2015), which are all hereby incorporated by reference in their entirety.

TECHNICAL FIELD

The present invention relates to a power cable, and more particularly, to an extra-high voltage underground or submarine cable. More particularly, the present invention relates to a power cable in which an insulation layer itself may have a high dielectric strength, an electric field to be applied to the insulation layer may be effectively buffered, degradation of the insulation layer may be prevented when the cable is used or during a connection process, resulting in an increase in the lifespan of the power cable, and the thickness of the insulation layer may be minimized, resulting in a reduction in the outer diameter of the power cable, whereby the power cable may achieve improvements in, for example, flexibility, ease of installation, and workability.

BACKGROUND ART

Although a power cable, which uses, as an insulation layer, a polymer insulator such as, for example, cross-linked polyethylene (XLPE), is used, due to the problem in which a space charge is created in a direct-current high electric field, a paper-insulated cable in which an insulation layer is formed by impregnating an insulating paper, which is wound to surround, for example, a conductor, with an insulation oil, is used as an extra-high voltage direct-current power transmission cable.

Examples of the paper-insulated cable may include an oil filled (OF) cable, which uses circulation of a low-viscosity insulation oil, and a mass impregnated non draining (MIND) cable, which is impregnated with a high-viscosity insulation oil. The OF cable has a limitation on the length along which a hydraulic pressure is transferred for the circulation of the insulation oil, and thus is not suitable for use as a long-distance power transmission cable. In particular, the OF cable is also not suitable for a submarine cable because it is difficult to install an insulation oil circulation facility underwater.

Therefore, the MIND cable is commonly used as a long-distance direct-current power transmission or submarine extra-high voltage cable.

Such a MIND cable is formed by surrounding an insulating paper in multiple layers when forming an insulation layer. As the insulating paper, for example, Kraft paper may be used, or a semi-synthetic paper may be used, in which Kraft paper and a thermoplastic resin such as, for example, a polypropylene resin, are stacked one above another.

In the case of a cable in which only Kraft paper is wound and is impregnated with an insulation oil, when the cable is used (upon electrical conduction), variation in temperature occurs due to the current that flows through a cable conductor, from an insulation layer portion on the radially inner side, i.e. on the inner semiconductive layer side to an insulation layer portion on the radially outer side, i.e. on the outer semiconductive layer side. Accordingly, the viscosity of the insulation oil in the insulation layer portion on the inner semiconductive layer side, which has a relatively high temperature, is reduced, whereby the insulation oil undergoes thermal expansion and moves to the insulation layer portion on the outer semiconductive layer side. Then, when the temperature drops, the viscosity of the insulation oil, which has moved due to thermal expansion, is increased, and thus the insulation oil has difficulty in moving to the original position thereof, whereby a de-oiling void may be formed in the insulation layer portion on the radially inner side, i.e. on the inner semiconductive layer side. Since the de-oiling void may cause an electric field to be concentrated thereon due to the absence of the insulation oil, for example, partial discharge or insulation destruction may occur in the vicinity of the void, which may reduce the lifespan of the cable.

However, when the insulation layer is formed of the semi-synthetic paper, the thermoplastic resin such as, for example, a polypropylene resin, which is not impregnated with the insulation oil when the cable is used, undergoes thermal expansion, which may suppress the flow of the insulation oil. In addition, since the polypropylene resin has an insulation resistance greater than that of the Kraft paper, even if the de-oiling void is formed, a voltage applied thereto may be attenuated.

In addition, the polypropylene resin, which is not impregnated with the insulation oil, may prevent the insulation oil from moving in the cable diametric direction due to the weight thereof, and may further suppress the movement of the insulation oil since the polypropylene resin undergoes thermal expansion according to the impregnation temperature upon the manufacture of the cable or the operating temperature when the cable is used, thereby applying surface pressure to the Kraft paper.

Meanwhile, for example, in Japanese Patent Laid-Open Publications No. 2010-097778, No. 2013-098136 and No. 2011-216292, a semi-synthetic paper and Kraft paper are mixed with each other in order to suppress the formation of a de-oiling void described above and to prevent an electric field from being concentrated immediately above a conductor and immediately below a sheath. However, in this case, optimum insulation design, i.e. realization of target resistance of an insulation layer and the minimum thickness of the insulation layer may be difficult, which results in an increase in the thickness of the insulation layer or a reduction in the lifespan of the cable due to the reduced dielectric strength. In addition, since a resin that constitutes the semi-synthetic paper, such as a polypropylene resin, is vulnerable to heat, upon a cable connection process, more particularly, upon a lead pipe connection process, the insulation layer may be degraded by the heat generated during welding, which may further reduce the lifespan of the cable.

Therefore, there is an urgent demand for a power cable in which an insulation layer itself may have a high dielectric strength, an electric field to be applied to the insulation layer may be effectively buffered, degradation of the insulation layer may be prevented when the cable is used or during a connection process, resulting in an increase in the lifespan of the power cable, and the thickness of the insulation layer may be minimized, resulting in a reduction in the outer diameter of the power cable, whereby the power cable may achieve improvements in, for example, flexibility, ease of installation, and workability.

DISCLOSURE

Technical Problem

It is one object of the present invention to provide a power cable, which may achieve an extended lifespan due to the high dielectric strength thereof and may achieve a reduced outer diameter by minimizing the thickness of an insulation layer, thereby achieving, for example, improvements in flexibility, ease of installation, and workability thereof.

In addition, it is another object of the present invention to provide a power cable, which may suppress the degradation of an insulation layer due to external heat upon a cable connection process, thereby achieving an extended lifespan thereof.

Technical Solution

To achieve the above-described object, in accordance with an aspect of the present invention, to accomplish the above and other objects, there is provided a power cable including a conductor, an inner semiconductive layer configured to surround the conductor, an insulation layer configured to surround the inner semiconductive layer and including an inner insulation layer, an intermediate insulation layer and an outer insulation layer, which are sequentially stacked one above another, an outer semiconductive layer configured to surround the insulation layer, a metal sheath layer configured to surround the outer semiconductive layer, and a cable protecting layer configured to surround the metal sheath layer, wherein each of the inner insulation layer and the outer insulation layer is formed of Kraft paper impregnated with an insulation oil, the intermediate insulation layer is formed of a semi-synthetic paper impregnated with the insulation oil, and the semi-synthetic paper includes a plastic film and Kraft paper stacked on at least one surface of the plastic film, wherein the inner insulation layer has a thickness ranging from 1% to 10% of an entire thickness of the insulation layer, the intermediate insulation layer has a thickness equal to or greater than 75% of the entire thickness of the insulation layer, and the outer insulation layer has a thickness ranging from 5% to 15% of the entire thickness of the insulation layer, and wherein the inner insulation layer and the outer insulation layer have a resistivity lower than a resistivity of the intermediate insulation layer.

Here, the power cable, which has the feature whereby the inner insulation layer has a maximum impulse electric field value smaller than a maximum impulse electric-field value of the intermediate insulation layer, is provided.

In addition, the power cable, which has the feature whereby the intermediate insulation layer has a maximum impulse electric field value equal to or less than 100 kV/mm, is provided.

In addition, the power cable, which has the feature whereby the plastic film has a thickness ranging from 40% to 70% of an entire thickness of the semi-synthetic paper, is provided.

In addition, the power cable, which as the feature whereby the thickness of the outer insulation layer is greater than the thickness of the inner insulation layer, is provided.

In addition, the power cable, which has the feature whereby the thickness of the outer insulation layer ranges from 1.25 times to 3 times the thickness of the inner insulation layer, is provided.

Meanwhile, the power cable, which has the feature whereby the thickness of the inner insulation layer ranges from 0.1 mm to 2.0 mm, the thickness of the outer insulation layer ranges from 1.0 mm to 3.0 mm, and the thickness of the intermediate insulation layer ranges from 15 mm to 25 mm, is provided.

In addition, the power cable, which has the feature whereby the Kraft paper in the inner insulation layer and the outer insulation layer has a thickness greater than a thickness of the Kraft paper in the semi-synthetic paper, is provided.

In addition, the power cable, which has the feature whereby the semi-synthetic paper has a thickness ranging from 70 μm to 200 μm, and the Kraft paper in the inner insulation layer and the outer insulation layer has a thickness ranging from 50 μm to 150 μm, is provided.

Meanwhile, the power cable, which has the feature whereby the conductor is formed of copper or aluminum, and is a straight-angle conductor configured by stacking a straight-angle wire on a circular center wire in multiple layers, or a circular compressed conductor configured by stacking a circular wire on a circular center wire in multiple layers and then compressing the resulting stack, is provided.

In addition, the power cable, which has the feature whereby the plastic film is formed of a polypropylene homopolymer resin, is provided.

In addition, the power cable, which has the feature whereby the insulation oil is a high-viscosity insulation oil having a kinematic viscosity of 500 centistokes or more at a temperature of 60° C., is provided.

Meanwhile, the power cable, which has the feature whereby the cable protecting layer includes an inner sheath, a bedding layer, a metal reinforcement layer, and an outer sheath, is provided.

Here, the power cable, which has the feature whereby the cable protecting layer further includes an iron wire outer shell and an outer subbing layer, is provided.

Advantageous Effects

A power cable according to the present invention may achieve not only a target dielectric strength, but also the minimum thickness of an insulation layer, through precise control of the structure and thickness of the insulation layer.

In addition, the power cable according to the present invention may suppress the degradation of the insulation layer due to heat upon a cable connection process by adjusting the thickness of each sub layer of the insulation layer, whereby the lifespan of the power cable may be extended.

MODE FOR INVENTION

Figure 1:
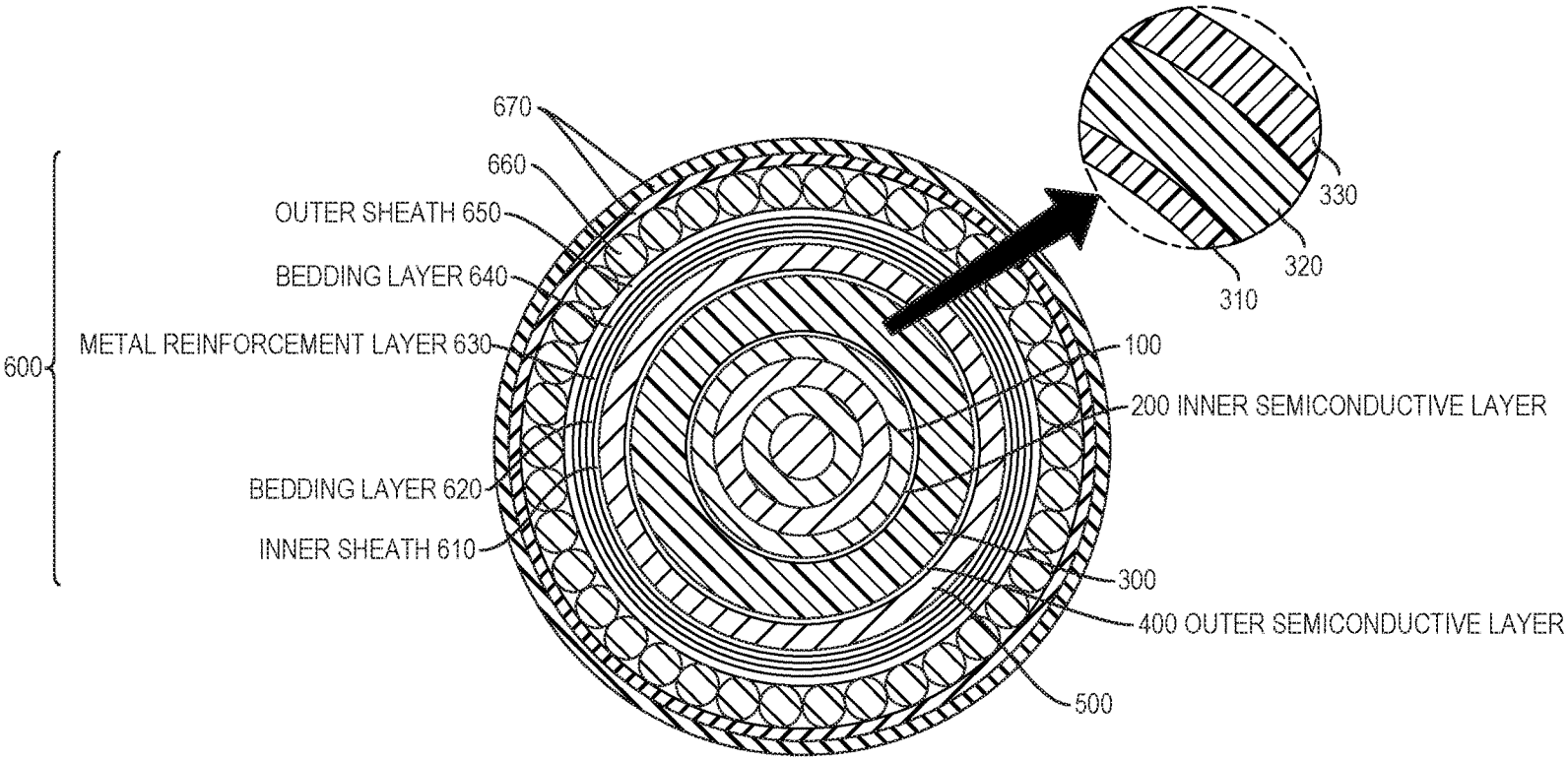
FIG. 1 schematically illustrates the structure of a transverse cross section of a power cable according to an embodiment of the present invention.

Hereinafter, exemplary embodiments of the present invention will be described in detail with reference to the accompanying drawings. However, the present invention is not limited to the embodiments described herein, and may be embodied into other forms. The embodiments introduced herein are provided in order to allow the disclosed content to be exhaustive and complete and to allow the scope of the present invention to be sufficiently transferred to those skilled in the art. The same reference numerals will designate the same constituent elements throughout the specification.

Figure 2:
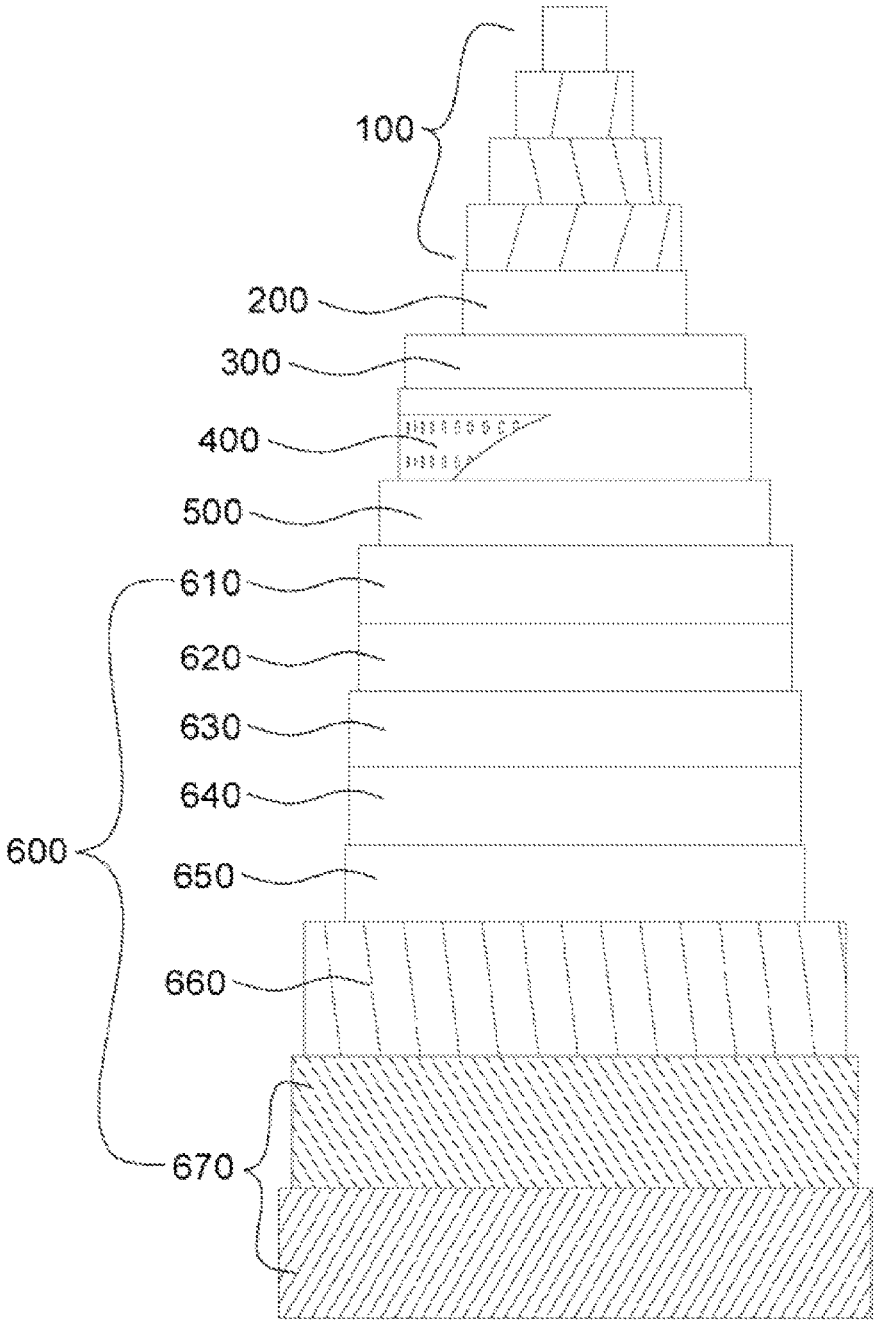
FIG. 2 schematically illustrates the structure of a longitudinal cross section of the power cable illustrated in FIG. 1.

FIGS. 1 and 2 schematically illustrate the structures of a transverse cross section and a longitudinal cross section of a power cable according to an embodiment of the present invention.

As illustrated in FIGS. 1 and 2, the power cable according to the present invention may include, for example, a conductor 100, an inner semiconductive layer 200 that surrounds the conductor 100, an insulation layer 300 that surrounds the inner semiconductive layer 200, an outer semiconductive layer 400 that surrounds the insulation layer 300, a metal sheath layer 500 that surrounds the outer semiconductive layer 400, and a cable protecting layer 600 that surrounds the metal sheath layer 500.

The conductor 100 may serve as a current movement passage for power transmission, and may be formed of a material that has excellent conductivity in order to minimize power loss and that also has appropriate strength and flexibility required for use as a cable conductor such as, for example, high-purity copper (Cu) or aluminum (Al), and more particularly, a soft copper wire having a high elongation percentage and high conductivity. In addition, the cross-sectional area of the conductor 100 may be changed according to, for example, the amount of power to be transmitted by the cable or the use purpose of the cable.

Preferably, the conductor 100 may be configured as a straight-angle conductor, which is formed by stacking a straight-angle wire on a circular center wire in multiple layers, or a circular compressed conductor, which is formed by stacking a circular wire on a circular center wire in multiple layers and then compressing the resulting stack. The conductor 100, which is configured as a straight-angle conductor formed in a so-called keystone manner, may reduce the outer diameter of the cable owing to the high space factor thereof, and may also allow each wire to be molded so as to have a large cross-sectional area, thereby reducing the total number of wires, which is economical.

The inner semiconductive layer 200 functions to suppress uneven charge distribution on the surface of the conductor 100, to buffer the distribution of an electric field from the inside of the cable, and to suppress, for example, partial discharge and insulation destruction by removing a gap between the conductor 100 and the insulation layer 300.

The inner semiconductive layer 200 may be formed, for example, by winding a carbon paper, which is obtained by processing an insulating paper with conductive carbon black, and the thickness of the inner semiconductive layer 200 may range from about 0.2 mm to about 1.5 mm.

The insulation layer 300 includes an inner insulation layer 310, an intermediate insulation layer 320, and an outer insulation layer 330, and the inner insulation layer 310 and the outer insulation layer 330 are formed of a material having resistivity lower than that of the intermediate insulation layer 320. Thereby, each of the inner insulation layer 310 and the outer insulation layer 330 performs an electric field buffering function to prevent a high electric field, which is created by current that flows through the conductor 100 when the cable is used, from being applied immediately above the conductor 100 or immediately below the metal sheath layer 500, and may also function to suppress the degradation of the intermediate insulation layer 320.

Figure 3:
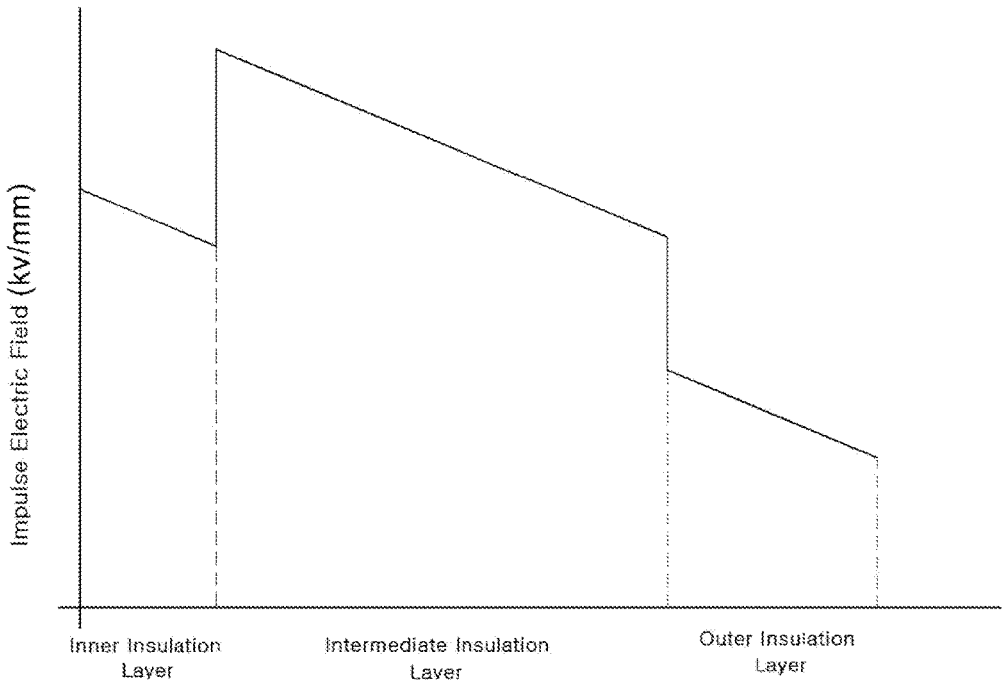
FIG. 3 illustrates a graph schematically representing the process of an electric field being buffered inside an insulation layer of the power cable according to the present invention.
Figure 4:
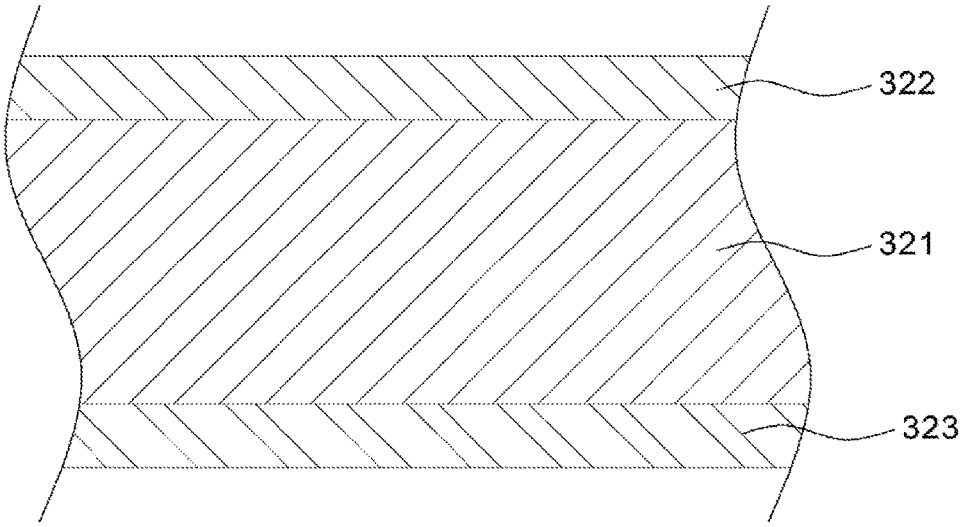
FIG. 4 schematically illustrates the structure of a cross section of a semi-synthetic paper, which forms an intermediate insulation layer of the power cable illustrated in FIG. 1.

FIG. 3 illustrates a graph schematically representing the process of an electric field being buffered inside the insulation layer of the power cable according to the present invention. As illustrated in FIG. 3, an electric field is buffered in the inner insulation layer 310 and the outer insulation layer 330, which have relatively low resistivity, which may effectively prevent a high electric field from being applied immediately above the conductor 100 and immediately below the metal sheath layer 500. In addition, degradation of the intermediate insulation layer 320 may be suppressed when the maximum impulse electric field, which is applied to the intermediate insulation layer 320, is controlled to 100 kV/mm or less.

Here, the impulse electric field is the electric field that is formed in the cable when an impulse voltage is applied to the cable. In addition, the inner electric field $E_i$ and the outer electric field $E_o$ of each of the inner insulation layer 310, the intermediate insulation layer 320 and the outer insulation layer 330 may be calculated using the following Equation 1.

$$E_i = \frac{2U_o}{d_{ii} \circ \ln(D_{io}/d_{ii})} \qquad \text{Equation 1}$$

$$E_o = \frac{2U_o}{d_{io} \circ \ln(D_{io}/d_{ii})}$$

In the above Equation 1, $U_o$ is the rating voltage of the cable, $D_{io}$ is the outer diameter of each insulation layer, and $d_{ii}$ is the inner diameter of each insulation layer.

Accordingly, as illustrated in FIG. 3, when design is performed such that the maximum impulse electric field value of the inner insulation layer is smaller than the maximum impulse electric field value of the intermediate insulation layer, a high electric field is not applied immediately above the conductor and immediately below the sheath. In addition, when the maximum impulse electric field applied to the intermediate insulation layer 320 is the inner electric field E of the intermediate insulation layer 320, and the inner electric field E is controlled to 100 kV/min or less, degradation of the intermediate insulation layer 320 may be suppressed.

Accordingly, it is possible to prevent a high electric field from being applied to the inner insulation layer 310 and the outer insulation layer 330, more particularly, for example, to a cable connection member that is vulnerable to an electric field, and to suppress degradation of the intermediate insulation layer 320, thereby suppressing deterioration in the dielectric strength and other physical properties of the insulation layer 300, and consequently suppressing a reduction in the lifespan of the cable.

According to an embodiment of the present invention, each of the inner insulation layer 310 and the outer insulation layer 330 may be formed by winding Kraft paper, the raw material of which is Kraft pulp, and impregnating the Kraft paper with an insulation oil. Thereby, the inner insulation layer 310 and the outer insulation layer 330 may have lower resistivity and a higher dielectric constant than those of the intermediate insulation layer 320. The Kraft paper may be manufactured by washing Kraft pulp with deionized water in order to remove an organic electrolyte from the Kraft pulp so as to acquire a good dissipation factor and dielectric constant.

The intermediate insulation layer 320 may be formed by winding a semi-synthetic paper in which Kraft paper is stacked on the upper surface and/or the lower surface of a plastic film and impregnating the semi-synthetic paper with an insulation oil. The intermediate insulation layer 320 formed as described above has higher resistivity and a lower dielectric constant than those of the inner insulation layer 310 and the outer insulation layer 330 because it includes the plastic film, and the outer diameter of the cable may be reduced by the high resistivity of the intermediate insulation layer 320.

In the semi-synthetic paper used to form the intermediate insulation layer 320, the plastic film may prevent the insulation oil impregnated in the insulation layer 300 from moving toward the outer semiconductive layer 400 by heat generation during cable operation, thereby preventing the formation of a de-oiling void due to the movement of the insulation oil, and consequently preventing the concentration of an electric field and insulation destruction due to the de-oiling void. Here, the plastic film may be formed of a polyolefin-based resin such as, for example, polyethylene, polypropylene or polybutylene, or a fluorine resin such as, for example, a tetrafluoroethylene-hexafluoro polypropylene copolymer or an ethylene tetrafluoroethylene copolymer, and preferably, may be formed of a polypropylene homopolymer resin having good heat resistance.

In addition, the thickness of the plastic film may range from 40% to 70% of the entire thickness of the semi-synthetic paper. When the thickness of the plastic film is below 40% of the entire thickness of the semi-synthetic paper, the resistivity of the intermediate insulation layer 320 may be insufficient, thus resulting in an increase in the outer diameter of the cable. On the other hand, when the thickness of the plastic film exceeds 70% of the entire thickness, a high electric field may be applied to the intermediate insulation layer 320.

The thickness of the inner insulation layer 310 may range from 1% to 10% of the entire thickness of the insulation layer 300, the thickness of the outer insulation layer 330 may range from 5% to 15% of the entire thickness of the insulation layer 300, and the thickness of the intermediate insulation layer 320 may be 75% or more of the entire thickness of the insulation layer 300. Thereby, the maximum impulse electric field value of the inner insulation layer 310 may be lower than the maximum impulse electric value of the intermediate insulation layer 320. When the thickness of the inner insulation layer is increased more than necessary, the maximum impulse electric field value of the inner insulation layer 310 becomes greater than the maximum impulse electric field value of the intermediate insulation layer 320, and the outer diameter of the cable may be increased. In addition, preferably, the outer insulation layer 330 may have a sufficient thickness, compared to the inner insulation layer. This will be described below.

In addition, in the present invention, through the provision of the inner insulation layer 310 and the outer insulation layer 330, which have low resistivity, it is possible to prevent a high electric field from being applied immediately above the conductor 100 and immediately below the metal sheath layer 500. In addition, as a result of designing the thickness of the intermediate insulation layer 320 having high resistivity so as to be 75% or more of the entire thickness of the insulation layer, the outer diameter of the cable may be reduced.

As described above, when the inner insulation layer 310, the intermediate insulation layer 320 and the outer insulation layer 330, which constitute the insulation layer 300, have the precisely controlled respective thicknesses, the insulation layer 300 may achieve a target dielectric strength and the outer diameter of the cable may be minimized. In addition, when an electric field to be applied to the insulation layer 300 is most efficiently buffered, it is possible to prevent a high electric field from being applied immediately above the conductor 100 and immediately below the metal sheath layer 500, and in particular, to prevent deterioration in the dielectric strength and other physical properties of a cable connection member, which is vulnerable to an electric field.

Preferably, the thickness of the outer insulation layer 330 may be greater than the thickness of the inner insulation layer 310. For example, the thickness of the inner insulation layer 310 may range from 0.1 mm to 2.0 mm, the thickness of the outer insulation layer 330 may range from 1.0 mm to 3.0 mm, and the thickness of the intermediate insulation layer 320 may range from 15 mm to 25 mm.

The plastic film of the semi-synthetic paper, which forms the intermediate insulation layer 320, may be melted when heat generated upon lead pipe connection for the connection of the cable according to the present invention is applied to the insulation layer 300. Therefore, in order to protect the plastic film from the heat, the outer insulation layer 330 may need to attain a sufficient thickness, and the thickness of the outer diameter 330 may be greater than the thickness of the inner insulation layer 310. The thickness of the outer insulation layer 330 may range from 1.5 times to 30 times the thickness of the inner insulation layer 310.

In addition, the thickness of the semi-synthetic paper, which forms the intermediate insulation layer 320, may range from 70 μm to 200 μm, and the thickness of the Kraft paper, which forms the inner and outer insulation layers 310 and 320, may range from 50 μm to 150 μm.

In addition, the thickness of the Kraft paper that forms the inner and outer insulation layers 310 and 320 is greater than the thickness of the Kraft paper that constitutes the semi-synthetic paper.

When the thickness of the Kraft paper, which forms the inner and outer insulation layers 310 and 320, is excessively small, the Kraft paper may be broken upon winding due to the insufficient strength thereof, and the number of times the Kraft paper is wound for forming the insulation layer having a target thickness may be increased, causing deterioration in the productivity of the cable. On the other hand, when the thickness of the Kraft paper is excessively large, the entire volume of gaps between turns of the wound Kraft paper may be reduced, and thus a long time may be consumed for impregnation using the insulation oil and the amount of the insulation oil used for impregnation may be reduced, which makes it difficult to realize a target dielectric strength.

As the insulation oil impregnated in the insulation layer 300, a high-viscosity insulation oil having a relatively high viscosity is used because it is stationary, rather than circulating like an insulation oil that is used in a conventional OF cable. The insulation oil may serve to realize a target dielectric strength of the insulation layer 300, and may also serve as a lubricant to facilitate the movement of the insulating paper upon bending of the cable.

The insulation oil must not be oxidized by heat when it is in contact with copper and aluminum, which constitute the conductor 100, although it is not particularly limited thereto. The insulation oil also needs to have a sufficiently low viscosity at an impregnation temperature, for example, at a temperature of 100° C. or more in order to ensure easy impregnation of the insulation layer 300, but needs to have sufficiently high viscosity at an operating temperature when the cable is used, for example, at a temperature within a range from 80° C. to 90° C. so as not to flow down. For example, a high-viscosity insulation oil having a kinematic viscosity of 500 centistokes or more at a temperature of 60° C., more particularly, an insulation oil of one or more kinds selected from among the group consisting of, for example, a naphthene-based insulation oil, a polystyrene-based insulation oil, a mineral oil, an alkyl benzene or polybutene-based synthetic oil, and heavy alkylate may be used.

The process of impregnating the insulation layer 300 with the insulation oil may be performed by winding each of the Kraft paper and the semi-synthetic paper, which constitute the inner insulation layer 310, the intermediate insulation layer 320 and the outer insulation layer 330, multiple times so that the respective insulation layers have target thicknesses, performing vacuum drying on the insulation layer 300 so as to remove, for example, residual moisture and impurities from the insulation layer, impregnating the insulation layer with the insulation oil, which is heated to a given impregnation temperature, for example, a temperature within a range from 100° C. to 120° C. under a high pressure environment for a given time, and gradually cooling the insulation layer.

The outer semiconductive layer 400 functions to buffer the distribution of an electric field by preventing uneven charge distribution between the insulation layer 300 and the metal sheath layer 500 and to physically protect the insulation layer 300 from the metal sheath layer 500 having any of various shapes.

The outer semiconductive layer 400 may be formed, for example, by winding a carbon paper, which is formed by processing an insulating paper with conductive carbon black and a metalized paper in which a thin aluminum film is stacked on Kraft paper, and the thickness of the outer semiconductive layer 400 may range from about 0.1 mm to about 1.5 mm. In particular, the metalized paper may have a plurality of holes formed therein in order to allow the insulation layer 300, which is disposed below the outer semiconductive layer 400, to be easily impregnated with the insulation oil.

The metal sheath layer 500 may serve to equalize an electric field inside the insulation layer 300 and to achieve an electrostatic shield effect by preventing an electric field from being emitted outward from the cable. In addition, the metal sheath layer may serve as a return path of failure current via grounding at one end of the cable when a ground fault or a short-circuit fault of the cable occurs so as to ensure safety, and may also serve to protect the cable from, for example, external shocks and pressure outside the cable and to increase, for example, the waterproofing ability and the flame retardancy of the cable.

The metal sheath layer 500 may be formed, for example, by a lead sheath formed of a lead alloy. The lead sheath, which forms the metal sheath layer 500, has a relatively low electrical resistance, and thus functions as a shield body for high current. The lead sheath may achieve further improvements in the waterproofing ability, the mechanical strength, and the fatigue characteristics of the cable when it is configured as a seamless type.

In addition, an anti-corrosion compound, for example, a blown asphalt may be applied to the surface of the lead sheath, in order to achieve further improvements in, for example, the corrosion resistance and the waterproofing ability of the cable and to increase adhesive force between the metal sheath layer 500 and the cable protecting layer 600.

The cable protecting layer 600 may include, for example, an inner sheath 610, a metal reinforcement layer 630, bedding layers 620 and 640 disposed above and below the metal reinforcement layer 630, and an outer sheath 650. Here, the inner sheath 610 may function to improve, for example, the corrosion resistance and the waterproofing ability of the cable and to protect the cable from mechanical damage, heat, fire, ultraviolet light, and insects or other animals. The inner sheath 610 may be formed of polyethylene, which has, for example, excellent cold resistance, oil resistance, and chemical resistance, or polyvinyl chloride, which has, for example, excellent chemical resistance and flame retardancy, without being particularly limited thereto.

The metal reinforcement layer 630 may function to protect the cable from mechanical shocks and may be formed of a piece of galvanized steel tape in order to prevent corrosion, and an anti-corrosion compound may be applied to the surface of the piece of galvanized steel tape. In addition, the bedding layers 620 and 640, which are disposed above and below the metal reinforcement layer 630, may function to buffer, for example, external shocks and pressure, and may be formed of, for example, a piece of non-woven fabric tape.

The outer sheath 650 has substantially the same function and characteristics as the inner sheath 610. Since a fire in a submarine tunnel and an onshore tunnel is a dangerous incident having a great effect on personal or facility safety, the outer sheath of the cable used in the corresponding area may be formed using polyvinyl chloride having excellent fire retardancy, and the outer sheath of the cable in a channel section may be formed using polyethylene having excellent mechanical strength and cold resistance.

In addition, when the cable is a submarine cable, the cable protecting layer 600 may further include, for example, an iron wire outer shell 600 and an outer subbing layer 670 formed of, for example, polypropylene yarns. The iron wire outer shell 600 and the outer subbing layer 670 may function to additionally protect the cable from, for example, a submarine sea current and rocks.

Although the exemplary embodiments of the present invention have been described above in detail, the present invention may be modified and altered in various ways by those skilled in the art within the scope and range of the present invention described in the following claims. Hence, it should be understood that the modifications are included in the technical scope of the present invention so long as they basically include constituent elements of the claims of the present invention.

The invention claimed is:

1. A power cable comprising:

a conductor;

an inner semiconductive layer configured to surround the conductor;

an insulation layer configured to surround the inner semiconductive layer and including an inner insulation layer, an intermediate insulation layer and an outer insulation layer, which are sequentially stacked one above another;

an outer semiconductive layer configured to surround the insulation layer;

a metal sheath layer configured to surround the outer semiconductive layer; and a cable protecting layer configured to surround the metal sheath layer, wherein each of the inner insulation layer and the outer insulation layer is formed of Kraft paper impregnated with an insulation oil, the intermediate insulation layer is formed of a semi-synthetic paper impregnated with the insulation oil, and the semi-synthetic paper includes a plastic film and Kraft paper stacked on at least one surface of the plastic film, wherein the inner insulation layer has a thickness ranging from 1% to 10% of an entire thickness of the insulation layer, the intermediate insulation layer has a thickness equal to or greater than 75% of the entire thickness of the insulation layer, and the outer insulation layer has a thickness ranging from 5% to 15% of the entire thickness of the insulation layer, wherein the inner insulation layer and the outer insulation layer have a resistivity lower than a resistivity of the intermediate insulation layer, wherein the thickness of the outer insulation layer ranges from 1.5 times to 30 times the thickness of the inner insulation layer, and wherein the Kraft paper in the inner insulation layer and the outer insulation layer has a thickness greater than a thickness of the Kraft paper in the semi-synthetic paper.

2. The power cable according to claim 1, wherein the thickness of the inner insulation layer ranges from 0.1 mm to 2.0 mm, and the thickness of the intermediate insulation layer ranges from 15 mm to 25 mm.

3. The power cable according to claim 1, wherein the inner insulation layer has a maximum impulse electric field value smaller than a maximum impulse electric-field value of the intermediate insulation layer.

4. The power cable according to claim 1, wherein the intermediate insulation layer has a maximum impulse electric field value equal to or less than 100 kV/mm.

5. The power cable according to claim 1, wherein the plastic film has a thickness ranging from 40% to 70% of an entire thickness of the semi-synthetic paper.

6. The power cable according to claim 1, wherein the semi-synthetic paper has a thickness ranging from 70 μm to 200 μm, and the Kraft paper in the inner insulation layer and the outer insulation layer has a thickness ranging from 50 μm to 150 μm.

7. The power cable according to claim 1, wherein the conductor is formed of a soft copper wire or aluminum, and is a straight-angle conductor configured by stacking a straight-angle wire on a circular center wire in multiple layers, or a circular compressed conductor configured by stacking a circular wire on a circular center wire in multiple layers and then compressing the resulting stack.

8. The power cable according to claim 1, wherein the plastic film is formed of a polypropylene homopolymer resin.

9. The power cable according to claim 1, wherein the insulation oil is a high-viscosity insulation oil having a kinematic viscosity of 500 centistokes or more at a temperature of 60° C.

10. The power cable according to claim 1, wherein the cable protecting layer includes an inner sheath, a bedding layer, a metal reinforcement layer, and an outer sheath.

11. The power cable according to claim 10, wherein the cable protecting layer further includes an iron wire outer shell and an outer subbing layer.

* * * * *